US005921209A

United States Patent [19]

Regueiro

[11] Patent Number: 5,921,209

[45] Date of Patent: Jul. 13, 1999

[54] ROLLER ARRANGEMENT FOR VALVE TRAIN MECHANISM

[75] Inventor: Jose F. Regueiro, Rochester Hills, Mich.

[73] Assignee: Chrysler Corporation, Auburn Hills, Mich.

[21] Appl. No.: 08/920,910

[22] Filed: Aug. 29, 1997

[51] Int. Cl.[6] ..... F01L 1/26

[52] U.S. Cl. ..... 123/90.22; 123/90.5

[58] Field of Search ..... 123/90.22, 90.23, 123/90.33, 90.35, 90.36, 90.39, 90.41, 90.42, 90.44, 90.48, 90.5, 90.51

[56] References Cited

U.S. PATENT DOCUMENTS

| | | | |
|---|---|---|---|
| 1,565,223 | 12/1925 | Church | 123/90.5 |
| 3,822,683 | 7/1974 | Clouse | 123/90.5 |
| 4,335,685 | 6/1982 | Clouse | 123/90.5 |
| 5,010,856 | 4/1991 | Ojala | 123/90.36 |
| 5,186,130 | 2/1993 | Melchior | 123/90.5 |
| 5,239,951 | 8/1993 | Cecur | 123/90.5 |
| 5,261,361 | 11/1993 | Speil | 123/90.22 |
| 5,566,652 | 10/1996 | Deppe | 123/90.42 |
| 5,622,146 | 4/1997 | Speil | 123/90.22 |
| 5,638,783 | 6/1997 | Regueiro | 123/90.22 |
| 5,645,023 | 7/1997 | Regueiro | 123/90.27 |
| 5,676,098 | 10/1997 | Cecur | 123/90.5 |

*Primary Examiner*—Weilun Lo
*Attorney, Agent, or Firm*—Kenneth H. MacLean

[57] ABSTRACT

A valve train mechanism for an internal combustion engine that has a valve actuator formed with a partial cylindrical cavity which supports a shaftless roller in contact with a cam-lobe of a camshaft and serves to convert the rotary motion of the camshaft to linear movement of a valve.

1 Claim, 4 Drawing Sheets

ROLLER ARRANGEMENT FOR VALVE TRAIN MECHANISM

FIELD OF THE INVENTION

This invention concerns internal combustion engines and, more particularly, relates to an engine valve train mechanism with intake valves and exhaust valves and having actuators provide with a roller arrangement engaged by a cam-lobe shaft for actuating the intake and exhaust valves.

BACKGROUND OF THE INVENTION

My co-pending United States patent application Ser. No. 08/629,161, filed on Apr. 8, 1996, now U.S. Pat. No. 5,645,023, discloses a valve train mechanism which utilizes a finger follower provided with a roller which is in continuous engagement with a rotating cam lobe formed on a camshaft. The roller is supported for rotation by a shaft which is secured to an intermediate portion of the finger follower. As is well known to those skilled in the art of designing valve train mechanisms for internal combustion engines, a roller assembly of the type seen in the above-mentioned application has its supporting shaft retained by the finger follower by press-fitting the shaft into the side walls of the finger follower. In addition, in order to provide a low friction rolling motion of the roller, a series of circumferentially spaced needle bearings are interposed between the inner circular opening within the roller and the shaft.

One problem with the above-described roller assembly is that the finger follower must be much wider than needed so as to include side walls of sufficient strength in order to permit the press-fitting of the support shaft to the side walls. As should be apparent, a design of this type increases the weight of the finger follower. Moreover, the heavier finger follower demands a heavier valve spring and creates unnecessary dynamic problems during valve actuation. Such problems could be reduced lift of the valves, or increased forces, or limited engine speed.

Another problem with the roller assemblies disclosed in the above-identified application is that the diameter of the roller shaft is critical in controlling the shaft strength on bending and the shaft may also require a large diameter to prevent wear of the needle bearings. As a result, these considerations tend to control the diameter of the roller and can result in having a shaft diameter much larger than desired. There are two reasons for this. First, the shaft needs a certain radial wall thickness on the side wall bosses of the finger follower for support strength. Since the roller in contact with the cam-lobe must protrude over the maximum diameter of the shaft support bosses to avoid the cam-lobe from contacting the bosses instead of the roller, the roller radius is forced to be 1–1.25 mm larger than the radius of the bosses. This, in some cases, forces a larger than required roller and tends to increase the mass of the rocker arm and the spring forces to the detriment of the valve dynamics. Second, the radial stack-up of necessary dimensions outwardly from the center of the shaft for shaft strength and needle life also may force a larger than required roller diameter.

SUMMARY OF THE INVENTION

Accordingly, the present invention proposes a new form of roller assembly designed to be used with finger followers, rocker arms, bridge members, cross heads or any other form of valve actuators of a valve train mechanism for converting the rotary motion of a camshaft to linear movement of a valve.

More specifically, the valve train mechanism according to the present invention incorporates a valve actuator provided with a roller which is not supported for rotation by a shaft (hereinafter referred to as "a shaftless roller"). In this case, the roller is disposed in a machined half bearing which takes the form of a trough. The trough is configured as a partial cylindrical cavity which serves as a concave bearing surface for the roller and, in the case of a finger follower and a bridge member or crosshead, is located at the top of the structure. When the invention is employed with a rocker arm, the trough is formed in the bottom of one end of the rocker arm structure. Thus, by eliminating the support shaft and the needle bearings normally forming a part of the roller assembly, there is a reduction in parts and a lessening of precise machining with the result that the cost of the mechanism is reduced. It is intended that this new form of roller assembly according to the present invention provide higher reliability and durability with lower engine life-time costs.

Accordingly, an object of the present invention is to provide a new and improved valve train mechanism for an internal combustion engine employing a valve actuator provided with a shaftless roller which is in continuous contact with a cam-lobe of a camshaft for transmitting linear movement to a valve.

Another object of the present invention is to provide a new and improved valve train mechanism for an internal combustion engine that has a valve actuator formed with a partial cylindrical cavity which supports a shaftless roller in contact with a cam-lobe of a camshaft and serves to convert the rotary motion of the camshaft to linear movement of a valve.

A further object of the present invention is to provide a new and improved valve train mechanism having an actuator in the form of a finger follower one end of which is supported by the cylinder head and the other end of which serves to actuate a valve with an intermediate portion of the finger follower being provided with a shaftless roller in contact with a cam-lobe of a camshaft that upon rotation provides a valve lifting force to the shaftless roller so that the finger follower acts through the other end thereof to move the valve to the open position.

A still further object of the present invention is to provide a new and improved valve train mechanism having an actuator in the form of a rocker arm an intermediate portion of which is supported by the cylinder head for pivotal movement and having one end thereof engaging the upper end of a valve stem with the other end of the rocker arm being provided with a partial cylindrical cavity in which a shaftless roller is located and is in constant contact with a cam-lobe of a camshaft the rotation of which results in the rocker arm moving the valve to an open position.

A still further object of the present invention is to provide a new and improved valve train mechanism having an actuator that takes the form of a bridge member or crosshead for moving a pair of same function valves with an intermediate portion of the bridge member being formed with a partial cylindrical cavity in which a shaftless roller is disposed and is in continuous contact with the cam-lobe of a camshaft the rotation of which causes the bridge member to move the pair of valves downwardly to an open position.

Other objects, advantages, and features of the present invention will become apparent from the following detailed description of the invention when considered in conjunction with the following drawings in which:

DESCRIPTION OF AN EMBODIMENT

Figure 1:
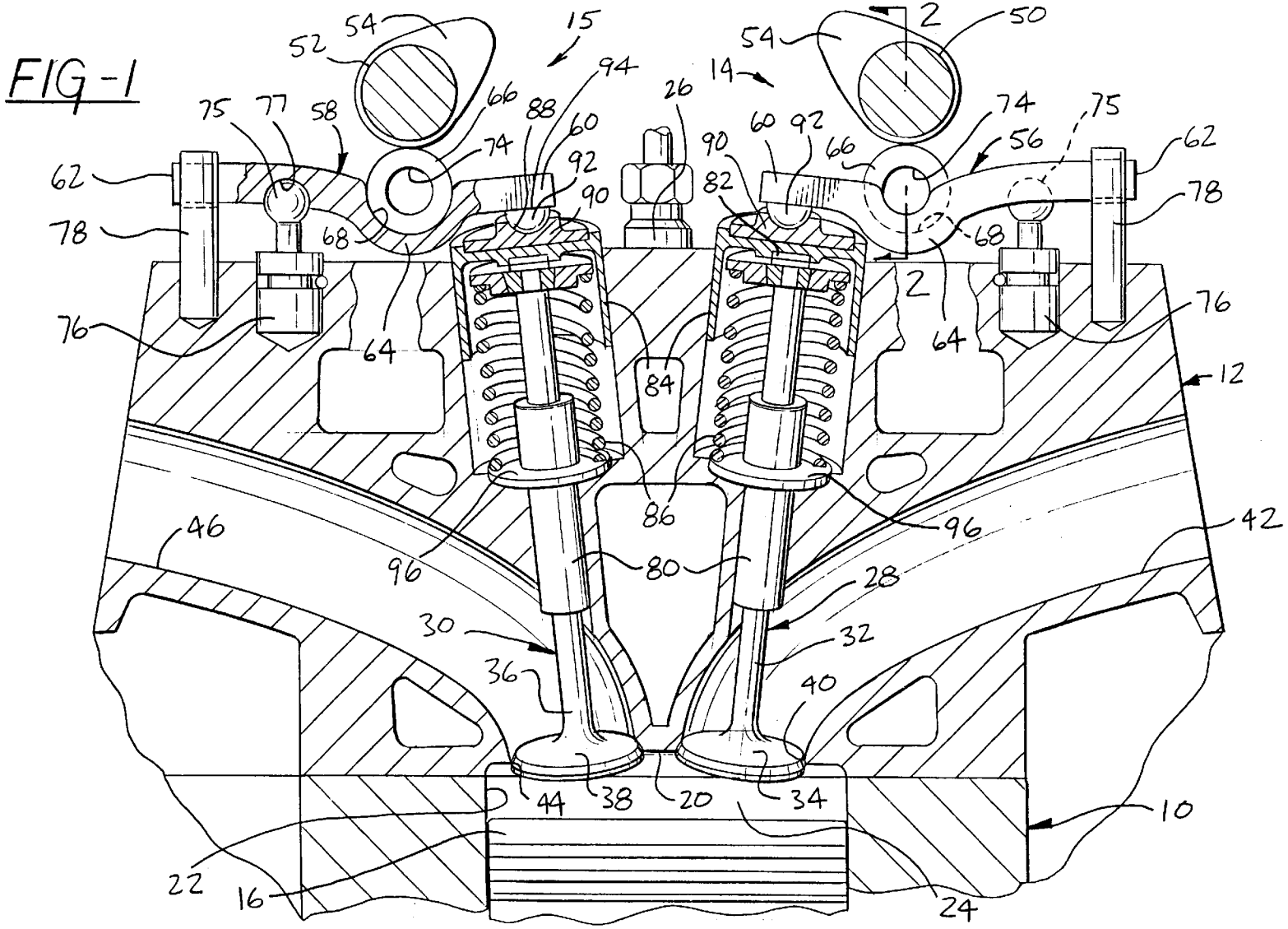
FIG. 1 is a view partially in section of a cylinder head incorporating a valve train mechanism including intake and exhaust valves that employs an actuator and roller assembly made in accordance with the present invention.

Referring now to the drawings and more particularly to FIG. 1 thereof, a single cylinder of a multi-cylinder engine is shown having an engine block 10 on which is secured by fasteners (not shown) a lower portion of a cylinder head 12 that incorporates a pair of identical valve train mechanisms 14 and 15.

Each of the cylinders of the engine house a piston 16 which moves axially along the longitudinal center axis of the associated cylinder and has the lower end thereof connected to the engine crankshaft (not shown) by a connecting rod (not shown). The cylinder head 12 is formed with a hemispherical surface 20 providing a recess which is aligned with the bore defining the associated cylinder 22 and together with the top of the piston 16 form a combustion chamber 24 which varies in volume during the operation of the engine. In this instance, a fuel injector 26 is threadably secured in the cylinder head 12 centrally of the hemispherical surface or recess 20 along the longitudinal axis of each cylinder 22. As will become apparent as the description of the present invention proceeds, the valve train mechanisms 14 and 15 according to the present invention can also be used with a spark ignition internal combustion engine.

As seen in FIG. 1, the cylinder head 12 is provided with an intake valve 28 and an exhaust valve 30 located in side-by-side relationship. At this juncture, it will be understood that at each cylinder of the engine, an additional pair of similar valve train mechanisms (not shown) are positioned adjacent the valve train mechanisms 14 and 15 so as to provide four valves per cylinder. Accordingly, although not shown in FIG. 1 of the drawings, the intake valve 28 works with a similar intake valve for providing air into the cylinder 22 and an exhaust valve similar to exhaust valve 30 serves to exhaust the exhaust gases from the cylinder 22 during operation of the engine.

With further reference to FIG. 1, it will be noted that the intake valve 28 has a valve stem 32 the lower end of which is formed with a round valve head 34. Similarly, the exhaust valve 30 has a valve stem 36 the lower end of which is formed with a round valve head 38. As is conventional, each of the intake valve heads 34 is normally seated in a valve seat formed in the cylinder head that defines a round opening or port 40 of an intake passage 42 formed in the cylinder head 12 as seen in FIG. 1. Also, the exhaust valve head 38 is normally seated in a valve seat formed in the cylinder head 12 that defines a round opening or port 44 of an exhaust passage 46 formed in the cylinder head 12.

It will be noted that the valve stem 32 of the intake valve 28 and the valve stem 36 of the exhaust valve 30 are disposed radially about the cylinder head 12 such that the intersection of their longitudinal center axes occurs at a point located on the longitudinal center axis of the cylinder 22. As a result, the center of the valve head 34 of the intake valve 28 and the center of the valve head 38 of the exhaust valve 30 and the centers of the adjacent exhaust and intake valves (not shown) for the cylinder 22 are located on a common circle concentric with the periphery of the cylinder 22. Thus, the longitudinal centerline of each intake valve and each exhaust valve for cylinder 22 is canted at an equal angle to both the longitudinal and transversal planes of the engine.

As seen in FIG. 1, a pair of laterally spaced overhead camshafts 50 and 52 are rotatably supported in the upper portion of the cylinder head 12 by a camshaft base and camshaft cap (neither of which are shown) which are secured to the lower head portion of the cylinder head 12. Each of the camshafts 50 and 52 is supported for rotation about an axis that is substantially parallel to the rotational axis of the engine crankshaft and each camshaft 50 and 52 includes a plurality of cam-lobe, (one of which is only shown and identified by reference numeral 54) for actuating the valves 28 and 30 through actuator arms or finger followers 56 and 58.

Figure 2:
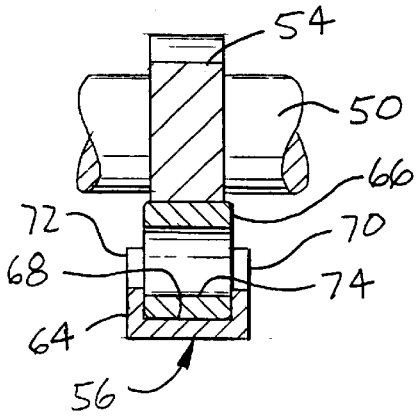
FIG. 2 is an enlarged sectional view taken on line 2—2 of FIG. 1.

In this regard, the finger followers 56 and 58 are identical in construction and each is formed as an elongated member having a head end 60 and a tail end 62 with a U-shaped saddle portion 64 intermediate the two ends that supports a cylindrical roller 66. The saddle portion 64 of the associated finger follower is provided with a machined cavity or trough defining a semi-cylindrical bearing surface 68 which serves as a saddle for roller 66. As seen in FIG. 2, the bearing surface 68 is bounded along its sides by a pair of laterally spaced side walls 70 and 72 which are integral with the body of the finger follower. The side walls 70 and 72 prevent axial displacement of the roller 66 and are of less radial length than the half diameter of the roller 66 so as to allow proper machining of the bearing surface 68.

As will become more apparent as the description of the invention proceeds, the roller 66 is disposed in the saddle portion 64 of the finger follower for rotation therein. In the preferred form, the radius of the bearing surface 68 will be slightly larger than the radius of the roller 66 so as to allow a film of oil to be maintained between the bearing surface and the outer surface of the roller. The roller 66 can be made as a solid member or, as seen in FIG. 2, have a hollow center defined by a circular hole 74 within the body of the roller 66 that extends through the body of the roller. By providing a hollow center in the roller 66, the weight of the roller 66 is reduced.

During operation of the valve train mechanisms 14 and 15, lubricating oil splashing about the overhead cylinder head of the engine will automatically cause the oil to find its way onto the bearing surface 68. As a result, the roller 66 and the bearing surface 68 in combination will operate in conformance with bearing-shaft hydrodynamic lubrication principles. In this case, the roller 66 acts as the theoretical shaft against the bearing surface 68 which is only half-diameter or less of the diameter of the roller 66. A larger bearing surface 68 is not necessary because the cam-lobe 54 effectively encapsulates the roller 66 so that it cannot be dislodged from its secure position relative to the bearing surface 68 inside the saddle portion 64.

Although not mentioned above, it will be noted that an added benefit in having each side wall 70 and 72 of minimum size is that there is reduced side wall exposure to the roller 66 and therefore friction by side shearing of the oil film between the ends of the roller and the side walls 70 and 72 is reduced. Also, the design of slimmer "cut-down" side walls 70 and 72 reduces the mass of the finger follower.

Each of the finger followers 56 and 58 support the associated roller 66 for rotation about an axis parallel to the rotational axis of the camshafts 50 and 52. In addition, each finger follower 56 and 58 is adapted to pivot about the ball portion 75 of a conventional hydraulic lash compensator 76 which is slidably disposed in the cylinder head 12. The ball portion 75 is received by a spherical recess 77 formed in the finger follower body between the roller 66 and the tail end 62 of the associated finger follower. In order to assure that each finger follower 56 and 58 will pivot about the ball portion 70 along a plane perpendicular to the rotational axes of the camshafts 50 and 52, the rectangularly shaped tail end 62 of each finger follower 56 and 58 is located within a slot formed in the upper end of a guide member 78 fixed with the cylinder head 12 as seen in FIG. 1.

Both the intake valve 28 and the exhaust valve 30 have their respective stems 32 and 36 extending upwardly from its valve head and passing through a guide sleeve 80 secured to the cylinder head 12. The flat upper end of each stem 32 and 36 abuts a flat anti-friction disc 82 which is disposed inside an associated inverted bucket tappet 84. Each inverted bucket tappet 84 is slidably mounted within the cylinder head 12 for linear reciprocal movement along an axis parallel or coaxial with the valve axis and against the bias of a compression spring 86, the upper end of which abuts a retainer secured to the upper end of the valve stem by a conventional two-piece lock. The top surface of each inverted bucket tappet is formed with a spherical recess 88 in which one part of a spherical joint is located.

In this regard, each spherical joint consists of a socket member 90 and a half-ball 92. The socket member 90 takes the form of a disc with the centrally located spherical recess 88 formed in the top surface of the socket member 90. The half-ball 96 has a spherical outer surface which is complementary in shape with the spherical recess 88 and is in contact therewith. The half-ball 92 also has a flat outer surface 94 which abuts the flat lower surface of the head end 60 of the associated finger follower.

It will be noted that the lower end of each compression spring 86 is seated on a washer 96 disposed in a conventional spot-faced recess formed in the lower head portion of the cylinder head 12. Thus, it should be apparent that the intake valve 28 and the exhaust valve 30 are normally maintained in the closed position shown by the associated compression spring 86. In addition, the fuel injector 26 is secured to the cylinder head 12 and is positioned centrally relative to the two intake valves and the two exhaust valves.

During operation of the valve train mechanism 14, the rotation of the camshaft 50 serves to actuate the finger follower 56 which, in turn, depresses the associated inverted bucket tappet 84. This occurs as the cam-lobe 54 of the camshaft 50 strokes the roller 66 of the finger follower 56 causing the head end 60 thereof to pivot downwardly about the ball portion 75 under the guidance of the guide member 78. As alluded to hereinbefore, the oil splashing about the overhead of the engine and under the valve cover falls on the roller 66 and into the radial clearance between the roller 66 and the bearing surface 68. This action provides a constantly replenished source of lubricant for the roller 66. As the roller 66 rotates under the influence of the rotating cam-lobe 54, it builds a hydrodynamic oil film wedge between it and the bearing surface 68 to prevent metal-to-metal contact between the two. An advantage of this design is that the diameter of the roller 66, being larger than the diameter of the shaft on conventional designs such as seen in my patent application mentioned above, generates the higher tangential speeds desired for proper hydrodynamic lubrication and the oil pooled in the cavity defined by the bearing surface 68 is readily available for pick-up by the roller 66 to do so. In contrast, the design of a shafted roller (such as seen in the patent application identified above) can not operate without the needle bearings because its peripheral speed between the hole in the roller and the diameter of the support shaft is far too low to generate enough hydrodynamic oil pressure for a full hydrodynamic lubrication regime and would not have the oil pooled at its disposition. This is why the needle bearings are needed in prior roller designs. However, in the roller arrangement according to the present invention, by shearing the oil in the clearance formed between the roller 66 and the bearing surface 68, more friction is generated, however, the increase in friction is of a different nature. That is, due to shearing of the oil film, it is harmless insofar as wear is concerned because of no damaging metal-to-metal contact. Even during the short duration periods of operation when the engine is under severe cold weather conditions and the oil has high viscosity, the friction increase is small and can be tolerated because it is only oil-shear friction, not metal-to-metal.

As the camshaft 50 rotates, the downward movement of the head end 60 of the finger follower 56 causes the intake valve 28 to be opened so as to allow communication between the intake passage 46 and the combustion chamber 24 via the port 40. As the inverted bucket tappet 84 associated with the intake valve 28 moves downwardly under the urging of the finger follower 56, the socket member 90 experiences a compound motion. That is, due to the inclination of the intake valve 28 as explained above, the socket member 90 moves downwardly along the longitudinal center axis of valve stem 32 and simultaneously moves radially inwardly towards the center of the cylinder. At the same time, the head end 60 of the finger follower 56 moves in a plane which is perpendicular to a plane passing through the rotational axes of the camshafts 50 and 52. The spherical joint composed of the socket member 90 and the half-ball 92 serves to compensate for this difference in transversal-angle plane between the inverted bucket tappet 84 and the finger follower 56. A more detailed explanation of this movement between the two can be obtained from my patent application referred to above.

Inasmuch as the valve train mechanism 15 is a mirror image of the valve train mechanism 14, it will be understood that rotation of the cam-lobe shaft 52 results in the same operation of the finger follower 58, the associated roller 66, and movement of the exhaust valve 30 as described above in connection with the valve train mechanism 14 and therefore needs not to be repeated herein.

Figure 3:
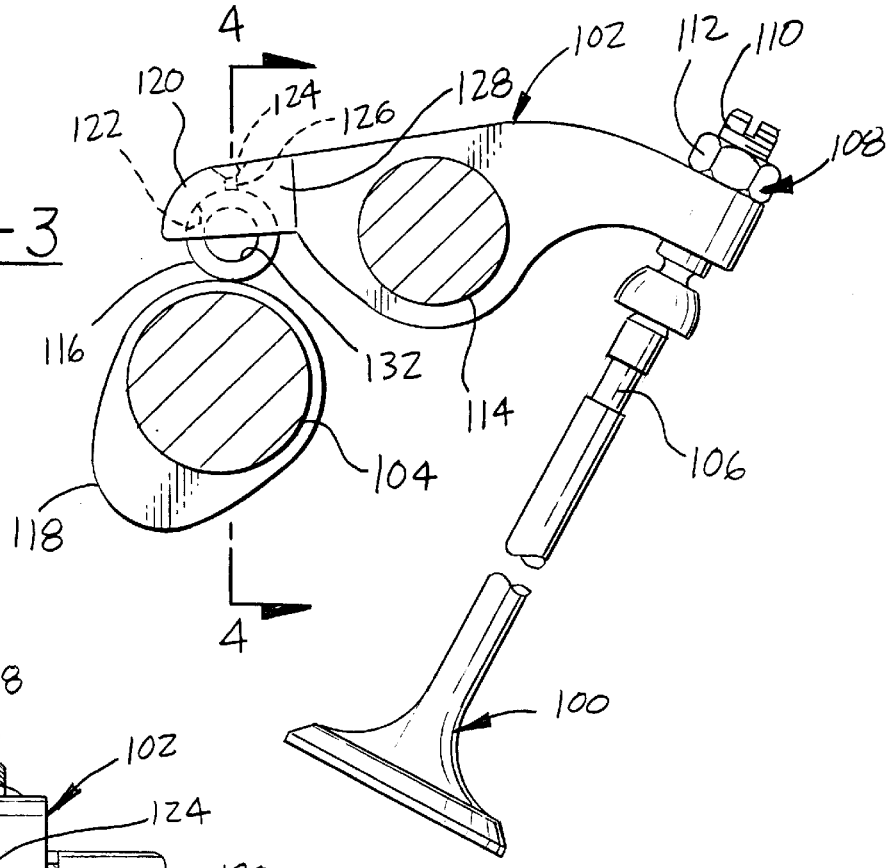
FIG. 3 is a view of an actuator in the form of a rocker arm employing a roller assembly of the type seen in FIGS. 1 and 2.
Figure 4:
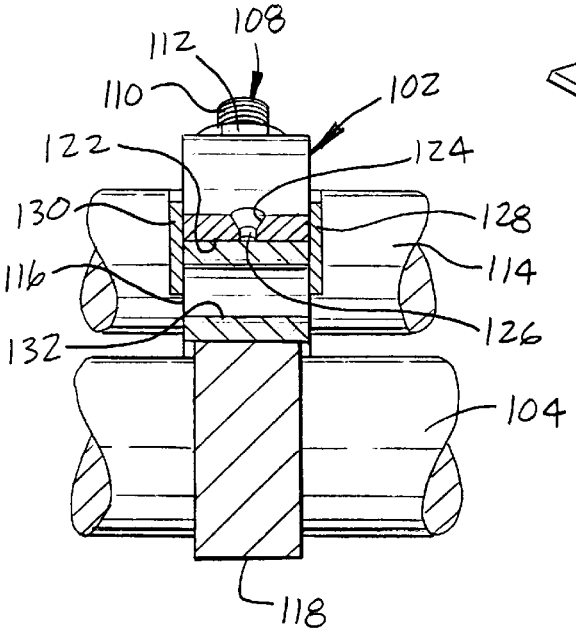
FIG. 4 is a sectional view taken on line 4—4 of FIG. 3.

FIGS. 3 and 4 show a valve train mechanism of an internal combustion engine provided with a roller arrangement according to the present invention that is similar to that described above except that the valves of the engine are to be moved to the open position by rocker arms rather than finger followers. In addition, although all the parts of an operating valve train mechanism are not shown in FIGS. 3 and 4, it will be understood that the valve 100 shown would be normally biased into a closed position relative to a port by a spring and that the rocker arm 102 and the camshaft 104 would be supported for rotation and pivotal movement, respectively, by the cylinder head of the engine. Also, the valve 100 can be an exhaust valve or an intake valve serving to open the port leading to a combustion chamber.

As seen in FIG. 3, the rocker arm 102 has a body portion one end of which contacts the upper end of the valve stem 106 of the valve 100 through a mechanical lash adjuster 108 composed of an adjusting screw 110, an elephant's foot, and a lock-nut 112. An intermediate part of the body portion of the rocker arm 102 is supported for pivotal movement by a shaft 114 while the other end of the body portion is provided with a shaftless roller 116 adapted to be contacted by a cam-lobe 118 of the camshaft 104. The roller 116 is essentially the same in construction as the roller 66 and is located in a saddle portion 120 formed at one end of the rocker arm 102. The saddle portion 120 includes a semi-cylindrical bearing surface 122 which faces downwardly rather then upwardly as in the case of the bearing surface 68 of the finger followers 56 and 58. Nonetheless, hydrodynamic lubrication can still be provided to the roller 116 with the oil being picked up from splash and oil vapors in the over head. However, a more effective lubrication method is provided in this case by having a depression or well 124 formed in the top side of the saddle portion 120 of the rocker arm 102 above the vertical center of the roller 116 to collect oil and by having the well 124 connected to the bearing surface 122 by a small hole 126. Thus, the inertial reaction force on the oil created by the acceleration of the rocker arm 102 as it pivots clockwise about the shaft 114 serves to drive the oil down to lubricate the roller 116.

In this embodiment of the invention as seen in FIGS. 3 and 4, the roller 116 is prevented from excessive axial movement by a pair of side walls 128 and 130. The side walls 128 and 130 can be integral with the rocker arm 124 or bonded thereto by a welding or brazing process. Also, the roller 116 is provided with a hole 132 so as to reduce the weight of the roller.

Figure 5:
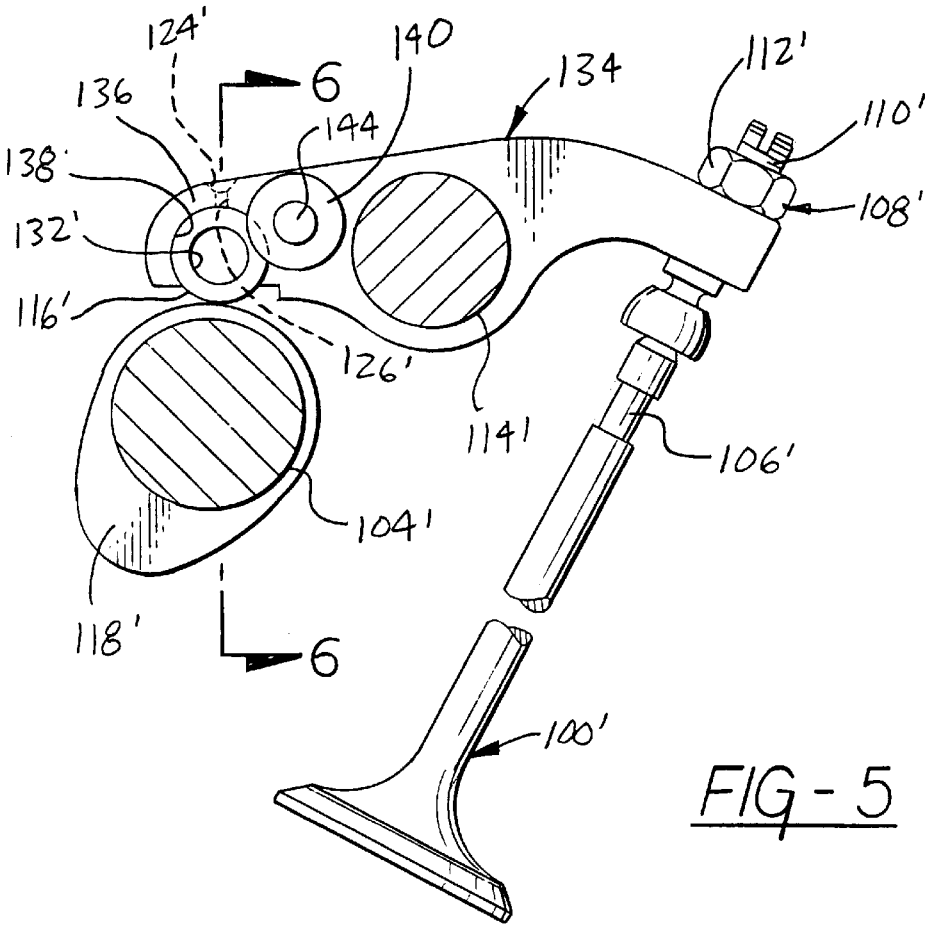
FIG. 5 is a view of a valve train mechanism having a rocker arm actuator similar to that seen in FIG. 4 but provided with a modified roller assembly.
Figure 6:
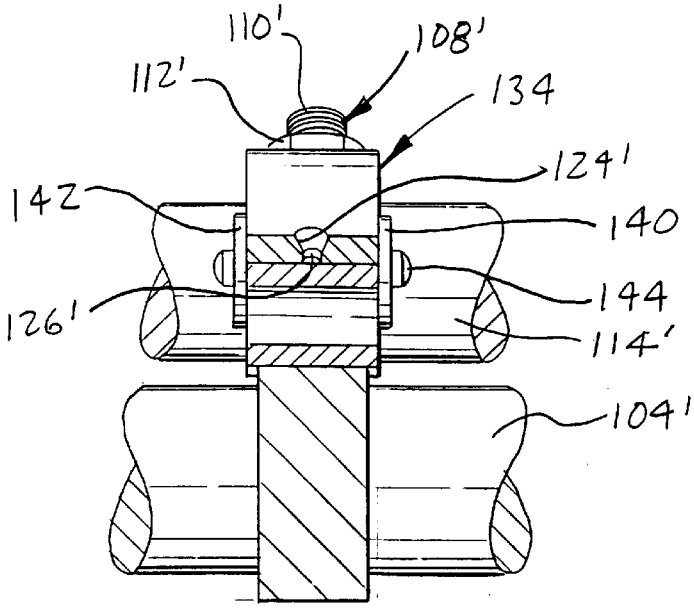
FIG. 6 is a sectional view taken on line 6—6 of FIG. 5.

FIGS. 5 and 6 show a valve train mechanism which is essentially identical to that seen in FIGS. 3 and 4 except for the manner that the roller is supported in the saddle portion of the rocker arm. Accordingly, parts of the valve train mechanism of FIGS. 5 and 6 that correspond identically to the parts of the valve train mechanism seen in FIGS. 3 and 4 will be identified by the same reference numerals but primed.

As seen in FIGS. 5 and 6, a rocker arm 134 has the shaftless roller 116' located in a saddle portion 136 which includes a cylindrical bearing surface 138 which is more than one-half the circumference of the roller 116'. This design can be used in cases where it may be desirable to assure that the roller 116' does not fall out of the bearing surface under any circumstances or where more than a one-half circumference is desirable to improve the bearing's ability to form a hydrodynamic oil film where oil supply may be limited. As should be apparent, a full circumference bearing surface can be initially machined in the body of the rocker arm 134 and, afterwards, the excess bearing surface can be cut off so that a portion of the roller 116' is exposed and more than one-half of the circumference of the bearing surface 138 serves to encapsulate the roller 116'. In addition, in order to prevent axial movement of the roller 116', a pair of identical washers 140 and 142 are provided which partially cover the end portion of each side of the roller 116'. The washers 140 and 142 can be attached to the opposed sides of the rocker arm 134 by a long rivet 144 which would extend through the rocker arm 134 as seen in FIG. 6 or can be attached to the rocker arm by other means such as brazing.

With the roller 116 on the bottom side of the rocker arm 134 as seen in FIGS. 3 and 4, the problem of it falling out of the cavity in the rocker arm 134 during handling and assembly can be easily solved by using a dab of heavy grease in the bearing surface 138. For additional security, a simple assembly clip can be used for that purpose without any operational functions. Even simple metal or plastic clips can be used to prevent the roller from falling off during handling and assembly and afterwards the clips can be removed or alternatively left in place without any functional purpose.

Figure 7:
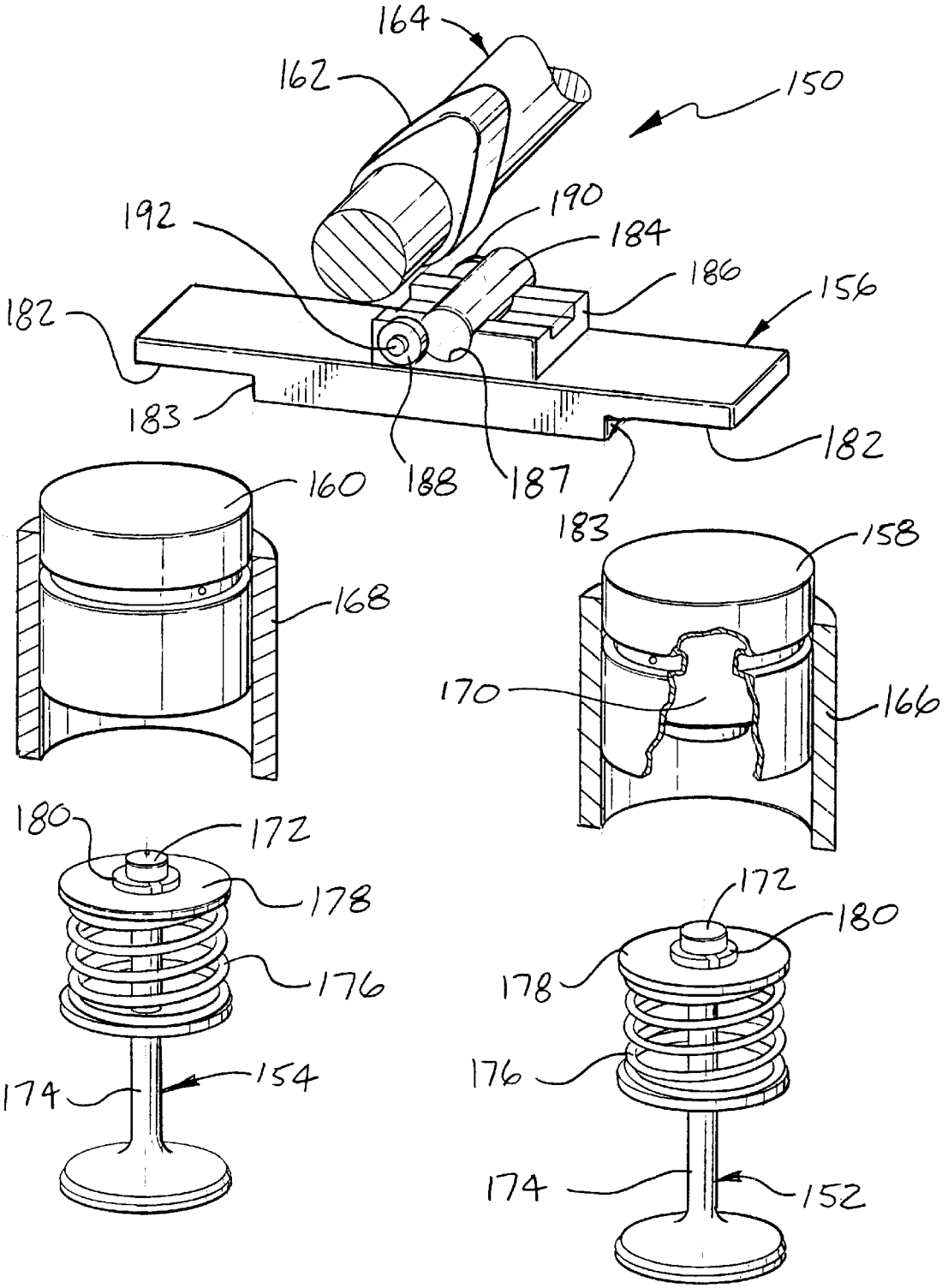
FIG. 7 is an exploded view in perspective showing a valve train mechanism having an actuator in the form of a bridge member that incorporates a roller assembly in accordance with the invention.

FIG. 7 is an isometric exploded view of some elements cut away and others in partial section for simplicity showing a valve train mechanism 150 according to the present invention for operating a pair of same function valves 152 and 154 in each cylinder of an internal combustion engine. The valves 152 and 154 can be a pair of exhaust valves, it being understood that a similar valve train mechanism having a pair of valves serving as intake valves would be located adjacent the valves for each cylinder of the engine.

This valve train mechanism 150 includes a floating bridge member or crosshead 156 abutting a pair of identical hydraulic tappets 158 and 160 intended to maintain a zero lash condition between the crosshead 156 and the cam-lobe 162 of a camshaft 164. The tappets 158 and 160 are slidably disposed in tappet guides 166 and 168, respectively, formed as an integral part of the cylinder head (not shown) or as an integrated part attached to the cylinder head. The bottom part of a hydraulic member 170 within each of the tappets 158 and 160 abuts the associated flat upper end 172 of the valve stem 174 of the associated valve 152, 154. Each of the valves 152 and 154 is biased towards a closed position by the spring 176 the upper end of which engages a retainer 178 disposed adjacent to the top end of the valve stem 174 and secured to it by a conventional two-piece lock 180.

The lower surface at each end of the crosshead 156 is provided with a semi-circular depression 182 which corresponds in configuration with the circular upper configuration of the associated tappet 158, 160. Thus, the depression 182 in each end of the crosshead 156 mate with the upper end of the associated tappet so that the crosshead 156 is prevented from disengagement from the associated tappet. Moreover, each of the valves 152 and 154 is intended to operate along a vertical axis and, therefore, the crosshead 156 is secured in place from horizontal plane displacement by having the internal circular edge 183 of the depression 182 mating with the circular diameter of an associated tappet.

The upper surface of the cross head 156 is provided with a low friction shaftless roller 184 disposed in a saddle portion 186 secured to the crosshead 156 midway between the two depressions 182, 182 located at opposed ends of the crosshead 156. The saddle portion 186, as in the case of the other valve mechanisms described above, is formed with cylindrical bearing surface 187 of a radius slightly greater than the radius of the roller 184. Also, as in the case of the prior described valve train mechanisms, the oil splashing about the overhead of the engine provides a source of lubricant between the outer peripheral surface of the roller 184 and the accommodating bearing surface 187 in the saddle portion 186. Thus, as the camshaft 164 rotates, the cam-lobe 162 in contact with the roller 184 causes the latter to rotate so that a hydrodynamic oil film wedge is build between the roller 184 and the bearing surface 187 to prevent metal-to-metal contact between the two. As in the case of the valve mechanism seen in FIGS. 5 and 6, axial displacement of the roller 184 is controlled by a pair of circular washers or end plates 188 and 190 either by securing each of them to the saddle portion 186 by a rivet 192 or by brazing. It will be understood that, as in the case of the other roller arrangement described above, the axial distance between the inside faces of the two end plates 188 and 190 will be slightly greater than the longitudinal length of the roller 184 so that lubricating oil can provide an anti-friction bearing between a side wall and the side of the roller.

Various changes and modifications can be made to the above described valve train mechanism without departing from the spirit of the invention. Such changes are contemplated by the inventor and he does not wish to be limited except by the scope of the appended claims.

What is claimed is as follows:

1. In a valve train mechanism of an internal combustion engine having a cylinder head, a camshaft supported for rotation in said engine, a pair of same function valves mounted in said cylinder head for movement between an open position and a closed position, each of said pair of valves being provided with a spring for biasing the associated valve into said closed position, a bridge member located between said camshaft and said pair of valves, a pair of tappets disposed above said pair of valves and being located in tappet guides formed in said cylinder head, said bridge member having its opposed ends serving to actuate said pair of valves through said pair of tappets, each of said opposed ends of said bridge member being provided with a semi-circular depression which corresponds in configuration with the upper configuration of the associated tappet so as to prevent horizontal plane displacement of said bridge member relative to said associated tappet, a saddle portion secured to said bridge member midway between said opposed ends of said bridge member, a cavity in the form of a concave bearing surface formed in said saddle portion, a shaftless roller located in said cavity, and a pair of washer like members connected to opposed sides of said saddle member to prevent said roller from moving axially relative to said cavity, said camshaft having a cam-lobe engaging and providing a valve lifting force to said shaftless roller to cause said bridge member to move downwardly as a unit to move each of said pair of valves to said open position against the bias of said associated spring.

* * * * *